US011448048B2

(12) United States Patent
Kuykendall

(10) Patent No.: US 11,448,048 B2
(45) Date of Patent: Sep. 20, 2022

(54) RECYCLE LOOP FOR A GAS LIFT PLUNGER

(71) Applicant: EPIC LIFT SYSTEMS LLC, Fort Worth, TX (US)

(72) Inventor: Schuyler Kuykendall, Granbury, TX (US)

(73) Assignee: EPIC LIFT SYSTEMS LLC, Fort Worth, TX (US)

( * ) Notice: Subject to any disclaimer, the term of this patent is extended or adjusted under 35 U.S.C. 154(b) by 0 days.

(21) Appl. No.: 16/735,769

(22) Filed: Jan. 7, 2020

(65) Prior Publication Data

US 2020/0141214 A1 May 7, 2020

Related U.S. Application Data

(63) Continuation of application No. 15/367,389, filed on Dec. 2, 2016, now Pat. No. 10,544,659.

(60) Provisional application No. 62/263,009, filed on Dec. 4, 2015.

(51) Int. Cl.
*E21B 43/12* (2006.01)
*F04B 47/12* (2006.01)

(52) U.S. Cl.
CPC ..... *E21B 43/122* (2013.01); *E21B 43/121* (2013.01); *F04B 47/12* (2013.01)

(58) Field of Classification Search
CPC ..... E21B 43/122; E21B 43/121; F04B 47/12
See application file for complete search history.

(56) References Cited

U.S. PATENT DOCUMENTS

| | | | | |
|---|---|---|---|---|
| 1,993,292 | A | 3/1935 | Woods | |
| 3,090,316 | A | 5/1963 | Montgomery | |
| 3,548,939 | A | 12/1970 | Bennett | |
| 4,211,279 | A | 7/1980 | Iscaacks | |
| 4,685,522 | A | 8/1987 | Dixon | |
| 5,146,991 | A * | 9/1992 | Rogers, Jr. | E21B 43/121 137/552.7 |
| 5,671,813 | A * | 9/1997 | Lima | E21B 23/08 166/372 |

(Continued)

OTHER PUBLICATIONS

Schuyler Kuykendall, "Recycle Loop for a Gas Lift Plunger", U.S. Appl. No. 15/377,429, filed Dec. 13, 2016.

(Continued)

*Primary Examiner* — Christopher J Sebesta
(74) *Attorney, Agent, or Firm* — Ewing & Jones, PLLC

(57) ABSTRACT

Apparatus, systems, and methods for operating a gas-lift plunger, of which the apparatus includes a controller configured to perform operations including receiving a signal from a sensor representing that a gas-lift plunger has reached a position is proximate to a top of a well. The operations include, in response to receiving the signal, causing a compressor to unload, and positioning a valve such that a gas flows from the compressor to a pressure vessel, and not into the well, and from the pressure vessel to the compressor. The operations include determining that the plunger has descended in the well, and in response to determining that the plunger has descended in the well, causing the compressor to load, and positioning the valve such that gas flows from the compressor to the well via the valve, the gas flowing from the pressure vessel into the inlet of the compressor.

20 Claims, 2 Drawing Sheets

(56) References Cited

U.S. PATENT DOCUMENTS

| | | | | |
|---|---|---|---|---|
| 5,735,346 | A | 4/1998 | Brewer | |
| 5,875,858 | A | 3/1999 | Brady | |
| 6,516,879 | B1 | 2/2003 | Hershberger | |
| 6,672,392 | B2 * | 1/2004 | Reitz | E21B 43/121 166/372 |
| 9,429,000 | B1 | 8/2016 | Velasquez | |
| 2002/0074118 | A1 | 6/2002 | Fisher | |
| 2003/0121656 | A1 | 7/2003 | Hershberger | |
| 2003/0145991 | A1 | 8/2003 | Olsen | |
| 2004/0244991 | A1 * | 12/2004 | Reitz | E21B 43/121 166/372 |
| 2007/0039739 | A1 | 2/2007 | Wilson | |
| 2008/0185141 | A1 | 8/2008 | Amies | |

OTHER PUBLICATIONS

George Sterling Gray, Final Office Action dated Jun. 12, 2019, U.S. Appl. No. 15/377,429, pp. 1-28.

* cited by examiner

RECYCLE LOOP FOR A GAS LIFT PLUNGER

CROSS-REFERENCE TO RELATED APPLICATIONS

This application claims priority U.S. patent application Ser. No. 15/367,389, which was filed on Dec. 2, 2016 and claims priority to U.S. Provisional Patent Application having Ser. No. 62/263,009, which was filed on Dec. 4, 2015. The entirety of each of these priority applications is incorporated by reference herein.

BACKGROUND

Gas lift plungers are employed to facilitate the removal of gas from wells, addressing challenges incurred by "liquid loading." In general, a well may produce both liquid and gaseous elements. When gas flow rates are high, the gas carries the liquid out of the well as the gas rises. However, as the pressure in the well decreases, the flowrate of the gas decreases to a point below which the gas fails to carry the heavier liquids to the surface. The liquids thus fall back to the bottom of the well, exerting back pressure on the formation, and thereby loading the well.

Plungers alleviate such loading by assisting in removing liquid and gas from the well, e.g., in situations where the ratio of liquid to gas is high. For example, the plunger is introduced into the top of the well. One type of plunger includes a bypass valve that is initially in an open position. When the bypass valve is in the open position, the plunger descends through a tubing string in the well toward the bottom of the well. Once the plunger reaches the bottom of the well, the bypass valve is closed. A compressed gas is then introduced into the well, below the plunger. The compressed gas lifts the plunger within the tubing string, causing any liquids above the plunger to be raised to the surface.

A compressor at the surface pressurizes the gas that is introduced into the well. As will be appreciated, the operation of the plunger is more efficient when the compressed gas is not introduced into the well as the plunger is descending. However, releasing the compressed gas into the atmosphere as the plunger descends generates a loud noise that may be harmful to the ears of those around. In addition, releasing the compressed gas into the atmosphere may also raise environmental concerns. Another option would be to turn the compressor off every time the plunger is descending; however, frequent switching of the compressor on and off may be inefficient and may reduce the lifespan of the compressor. What is needed is an improved system and method for redirecting the gas exiting the compressor as the plunger descends in the well.

SUMMARY

Embodiments of the disclosure may provide an apparatus for operating a gas-lift plunger in a well. The apparatus includes a controller in communication with a compressor, a valve, and a sensor. The controller is configured to perform operations including receiving a signal from the sensor representing that a gas-lift plunger has reached a position in a well that is proximate to a top of the well, in response to receiving the signal, causing the compressor to unload and positioning the valve in a first position such that a gas flows from an outlet of the compressor to a pressure vessel, and not into the well, and from the pressure vessel to an inlet of the compressor. The operations also include determining that the plunger has descended in the well, and in response to determining that the plunger has descended in the well, causing the compressor to load, and positioning the valve in a second position such that the gas flows from the outlet of the compressor to the well via the valve in the second position. The gas flows from the pressure vessel into the inlet of the compressor.

Embodiments of the disclosure may also provide a system for operating a gas-lift plunger in a well. The system includes a pressure vessel positioned outside of the well, wherein the pressure vessel is configured contain a gas therein, and a compressor having a driver, an inlet, and an outlet. The compressor is configured to compress the gas between the inlet and the outlet. The gas is fed to the inlet from the pressure vessel. The system further includes a valve coupled to the outlet of the compressor. The valve has a first position in which the valve directs the gas from the outlet of the compressor to the pressure vessel, and the valve has a second position in which the valve directs the gas from the outlet of the compressor to the well. The system also includes a controller in communication with the driver of the compressor and with the valve. The controller is configured to determine that the gas-lift plunger has reached a predetermined position in the well, and in response to determining that the gas-lift plunger has reached the predetermined position, cause the compressor to stop compressing the gas, and cause the valve to be in the first position such that the gas at the outlet of the compressor is directed into the pressure vessel and not to the well. The controller is also configured to determine that the gas-lift plunger has descended in the well, and in response to determining that the gas-lift plunger has descended in the well, cause the compressor to compress the gas and cause the valve to be in the second position such that the gas at the outlet of the compressor is directed to the well.

Embodiments of the disclosure may further provide a method for operating a gas-lift plunger in a well including receiving a signal from a sensor, the signal representing that the gas-lift plunger has reached a position in the well that is proximate to the top of the well. The method also includes, in response to receiving the signal, causing a compressor to stop compressing a gas between an inlet of the compressor and an outlet of the compressor, and positioning a valve in a first position, the valve in the first position being configured to receive the gas from the outlet of the compressor and feed the gas to a pressure vessel that is positioned outside of the well. The gas is received at the inlet of the compressor from the pressure vessel. The method further includes determining that the plunger has descended in the well, and, in response to determining that the plunger has descended in the well, causing the compressor to compress the gas between the inlet and the outlet of the compressor, and positioning the valve in a second position such that the gas flows from the outlet of the compressor to the well via the valve in the second position.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

Figure 1:
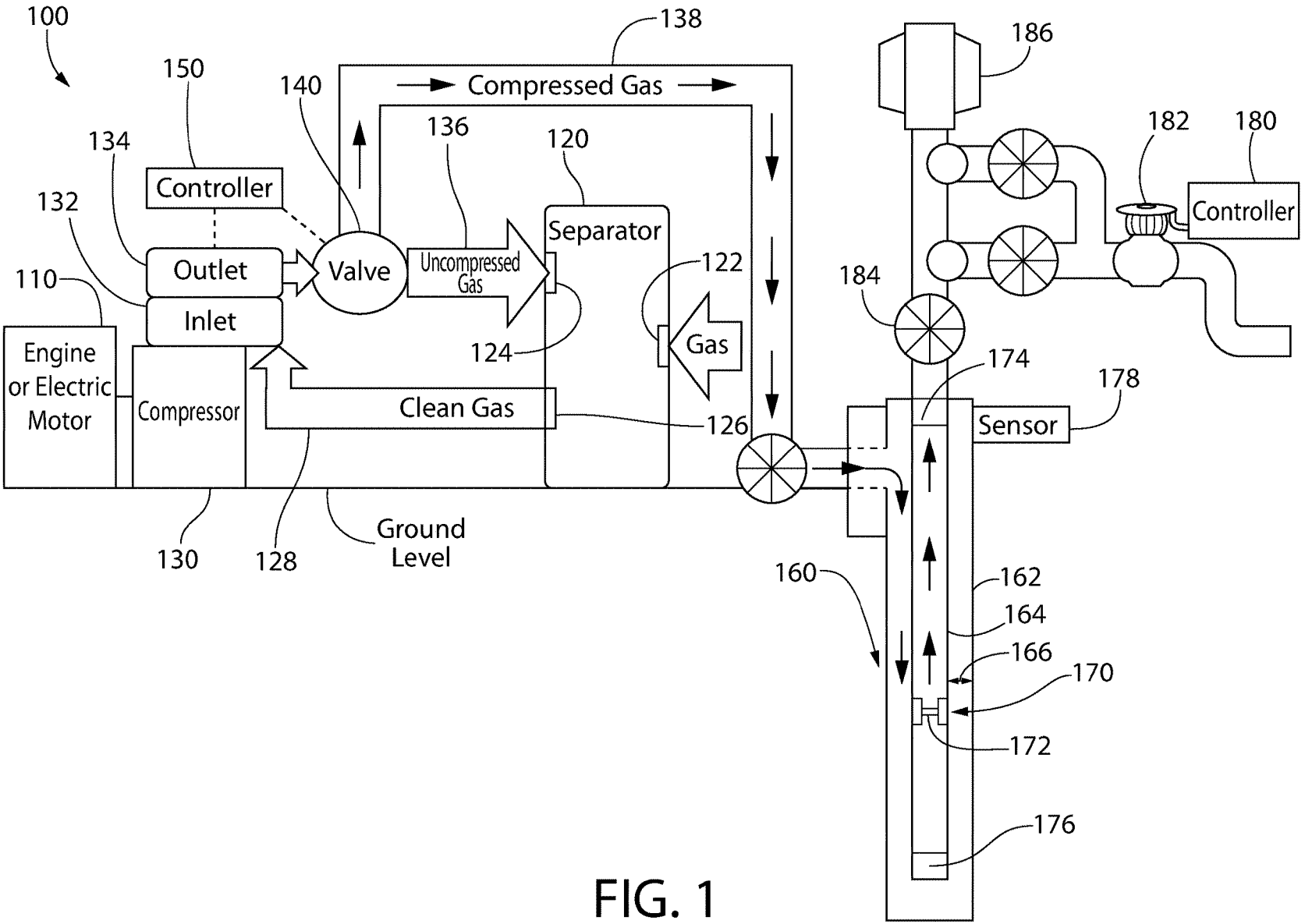
FIG. 1 illustrates a schematic view of a system for operating a gas lift plunger in a well, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a schematic view of a system 100 for operating a gas lift plunger 170 in a well 160, according to an embodiment. The system 100 may include a driver 110, such as an internal combustion engine or electric motor, a pressure vessel 120, and a compressor 130. When active, the driver 110 drives the compressor 130, such that the compressor 130 is capable of compressing gas.

The pressure vessel 120 may be a separator (e.g., a scrubber). The pressure vessel 120 may have one or more inlets (two are shown: 122, 124) and one or more outlets (one is shown: 126). The pressure vessel 120 may be configured to receive a gas through the first inlet 122, the second inlet 124, or both inlets 122, 124. Although not shown, in at least one embodiment, the pressure vessel 120 may include a single inlet, and the two inlet flows may both enter the pressure vessel 120 through the single inlet (e.g., via a T-coupling coupled to the single inlet). The pressure vessel 120 may then separate (i.e., remove) particles from the gas to clean the gas. In at least one embodiment, the pressure vessel 120 may be a gravity-base separator, such that the separation may be passive, allowing the denser solid particles to fall to the bottom of the pressure vessel 120. The clean gas may then exit the pressure vessel 120 through the outlet 126. The pressure vessel 120 may have an internal volume ranging from about 0.04 $m^3$ to about 0.56 $m^3$, or more.

The compressor 130 may include an inlet 132 that is coupled to and in fluid communication with the outlet 126 of the pressure vessel 120. The gas that flows out of the outlet 126 of the pressure vessel 120 may be introduced into the inlet 132 of the compressor 130, as shown by arrows 128. The compressor 130 may be configured to compress the gas received through the inlet 132. The gas may exit the compressor 130 through an outlet 134 of the compressor 130. The compressor 130 may be a reciprocating compressor. In other embodiments, the compressor 130 may be a centrifugal compressor, a diagonal or mixed-flow compressor, an axial-flow compressor, a rotary screw compressor, a rotary vane compressor, a scroll compressor, or the like.

A valve 140 may be coupled to and in fluid communication with the outlet 134 of the compressor 130. When the valve 140 is in a first position, the gas may flow through the valve 140 and be introduced back into the pressure vessel 120, as shown by arrows 136. For example, the gas may be introduced into the pressure vessel 120 through the second inlet 124. When the valve 140 is in a second position, the gas exiting the compressor 130 may flow through the valve 140 and be introduced into a well 160, as shown by arrows 138.

A first controller 150 may be coupled to the compressor 130 and/or the valve 140. As discussed in greater detail below, the first controller 150 may be configured to actuate the valve 140 between the first and second positions. In addition, the first controller 150 may be configured to cause the compressor 130 to not compress the gas during predetermined intervals. In other words, the gas flowing out through the outlet 134 of the compressor 130 may have substantially the same pressure as the gas flowing in through the inlet 132 of the compressor 130. In one embodiment, the compressor 130 may not compress the gas when the valve 140 is in the first position, and the compressor 130 may compress the gas when the valve 140 is in the second position.

Referring back to the well 160, a casing 162 may be coupled to the wall of the well 160 by a layer of cement. A tubing string (e.g., a production string) 164 may be positioned radially-inward from the casing 162. An annulus 166 may be defined between the casing 162 and the tubing string 164. A plunger 170 may be moveable within the tubing string 164. In some embodiments, a substantially fluid-tight seal may be formed between the outer surface of the plunger 170 and the inner surface of the tubing string 164. Optionally, a bore may be formed axially-through the plunger 170, and a valve 172 may be positioned within the bore. The valve 172 may be opened when the plunger 170 contacts a first actuator (e.g., "bumper spring") 174 proximate to the upper end of the tubing string 164. The valve 172 may be closed when the plunger 170 contacts a second actuator (e.g., "bump spring") 176 proximate to the lower end of the tubing string 164. In another embodiment, the plunger 170 may be a pad-type plunger.

The plunger 170 may cycle from the bottom of the well 160, to the top of the well 160, back to the bottom of the well 160, and so on. More particularly, when the valve 172 in the plunger 170 is in the closed position and the well 160 is producing enough gas to lift the liquid, the gas may lift the plunger 170, and the liquid that is above the plunger 170 in the tubing string 164, to the surface, e.g., when an outlet valve is opened at the surface. As discussed in more detail below, when the well 160 is not producing enough gas to lift the liquid to the surface, or the well 160 is not producing enough gas to lift the liquid to the surface within a predetermined amount of time, additional compressed gas (e.g., from the compressor 130) may be introduced into the well 160 to lift the plunger 170 and the liquid. When the plunger 170 reaches the surface and contacts the first actuator 174, the valve 172 in the plunger 170 may open, which may allow the plunger 170 to descend toward the bottom of the well 160.

When the plunger 170 reaches the bottom of the well 160 and contacts the second actuator 176, the valve 172 in the plunger 170 may close. Then, the gas produced in the well 160, the compressed gas introduced into the well 160, or a combination thereof may lift the plunger 170, and the liquid that is above the plunger 170 in the tubing string 164, back to the surface. The plunger 170 may continue to cycle up and down, lifting liquid to the surface with each trip.

The system 100 may also include a sensor 178 positioned proximate to the top of the well 160 (e.g., at or near the surface). The sensor 178 may be coupled to the tubing string 164, the first actuator 174, or other equipment at the surface. The sensor 178 may detect or sense each time the plunger 170 reaches the surface. In one embodiment, the sensor 178 may detect or sense when the plunger 170 is within a predetermined distance from the sensor 178. In another embodiment, the sensor 178 may detect or sense when the plunger 170 contacts the first actuator 174.

In yet another embodiment, the sensor 178 may be a pressure transducer that is coupled to the tubing string 164, the first actuator 174, the inlet 132 of the compressor 130, the outlet 134 of the compressor 130, or the like. It may be determined that the plunger 170 is at a predetermined position in the well 160 when the pressure measured by the pressure transducer is greater than or less than a predetermined amount. For example, a user may open or close a valve to cause the plunger 170 to ascend or descend within the well. The opening or closing of the valve may cause the pressure to increase or decrease beyond the predetermined amount, which may be detected by the sensor 178.

The system 100 may also include a second controller 180. The second controller 180 may communicate with the first controller 150 in response to the data from the sensor 178, as discussed in greater detail below. The system 100 may also include one or more valves (two are shown: 182, 184). The second controller 180 may close and open the first valve 182 depending on the point in the cycle to stop flow or allow the well 160 to produce. The second valve 184, above the well 160, may be a master valve. A lubricator 186 may be positioned above the second valve 184. The lubricator 186 houses a shift rod and shock absorber to actuate the plunger 170 at the surface. Although shown as different components, in another embodiment, the first actuator 174 and the lubricator 186 may be the same component.

Figure 2:
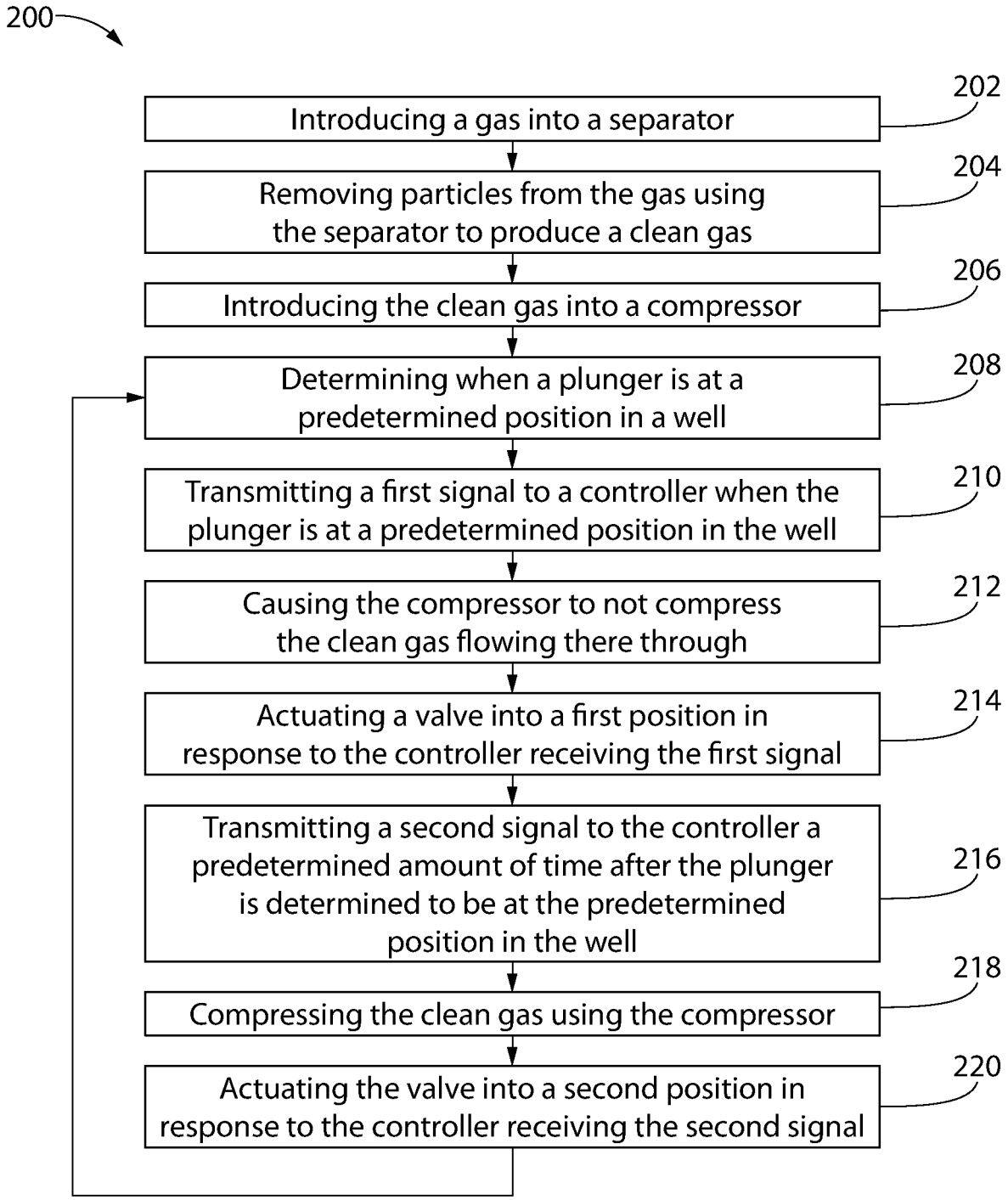
FIG. 2 illustrates a flowchart of a method for operating the gas lift plunger in the well, according to an embodiment.

FIG. 2 illustrates a flowchart of a method 200 for operating the gas lift plunger 170 in the well 160, according to an embodiment. The method 200 is described herein with reference to the system 100 in FIG. 1 as a matter of convenience, but may be employed with other systems. The method 200 may begin by introducing a gas into the pressure vessel 120, as at 202. The gas may be any mixture of natural gases. As described above, the gas may be introduced into the pressure vessel 120 through the first inlet 122 of the pressure vessel 120. The method 200 may then include removing particles from the gas using the pressure vessel 120 to produce a clean gas, as at 204. The method 200 may then include introducing the clean gas into the compressor 130, as at 206.

The method 200 may also include determining, using a sensor 178, when the plunger 170 is at a predetermined position in the well 160, as at 208. In one embodiment, the predetermined position may be proximate to the top of the well 160. In another embodiment, the predetermined position may be when the plunger 170 contacts the first actuator 174.

The sensor 178 may transmit a signal to the second controller 180 each time the sensor 178 detects the plunger 170. The method 200 may include transmitting a first signal from the second controller 180 to the first controller 150 when the plunger 170 is at the predetermined position, as at 210. The first signal may be transmitted through a cable or wire, or the first signal may be transmitted wirelessly. In the embodiment where the sensor 178 is a pressure transducer, the second controller 180 may be omitted, and the sensor 178 may send a signal directly to the first controller 150 when the measured pressure is greater than or less than the predetermined amount.

In response to receiving the first signal from the second controller 180 (or the signal from the sensor 178), the first controller 150 may cause the compressor 130 to not compress the gas flowing therethrough (i.e., "unload" the compressor 130 to provide an uncompressed gas), as at 212. In some embodiments, the uncompressed gas may still have a pressure greater than atmospheric pressure. The uncompressed gas may, however, have a lower pressure than the compressed gas (e.g., at 218 below). In response to receiving the first signal, the first controller 150 may also actuate the valve 140 at the outlet 134 of the compressor 130 into the first position, as at 214, such that the uncompressed gas that exits the compressor 130 flows back into the pressure vessel 120.

When the valve 140 at the outlet 134 of the compressor 130 is in the first position and the valve 172 in the plunger 170 is open (e.g., after contacting the first actuator 174), the plunger 170 may begin descending back to the bottom of the well 160. The uncompressed gas may continue to flow into the pressure vessel 120 as the plunger 170 descends. The uncompressed gas may only flow into the pressure vessel 120 up to the set suction pressure. The set suction pressure may be from about 15 psi to about 100 psi or more. The pressure vessel 120 may be certified for pressures ranging from about 100 psi to about 400 psi, about 400 psi to about 800 psi, about 800 psi to about 1200 psi, or more. The volume of the pressure vessel 120 (provided above) may be large enough to store the gas introduced from the compressor 130 while the plunger 170 descends in the well 160.

The method 200 may also include transmitting a second signal from the second controller 180 to the first controller 150 a predetermined amount of time after the plunger 170 is determined to be at the predetermined position in the well 160, as at 216. The second signal may be transmitted through a cable or wire, or the second signal may be transmitted wirelessly. In another embodiment, the first controller 150 may have a timer set to the predetermined amount of time so that the second signal from the second controller 180 is not needed. The predetermined amount of time may be the time (or slightly more than the amount of time) that it takes for the plunger 170 to descend back to the bottom of the well 160 (e.g., to contact the second actuator 176), which may be known or estimated. For example, the density of the plunger 170, the density of the fluids in the well 160, and the distance between the first and second actuators 174, 176 may all be known or estimated. This may enable a user to calculate or estimate the time for the plunger 170 to descend to the bottom of the well 160.

In response to receiving the second signal, the first controller 150 may cause the compressor 130 to compress the clean gas from the pressure vessel 120 to provide a compressed gas, as at 218. In response to receiving the second signal, the first controller 150 may also actuate the valve 140 at the outlet 134 of the compressor 130 into the second position, as at 220, such that the compressed gas that exits the compressor 130 flows into the well 160, as shown by arrows 138 in FIG. 1. In another embodiment, the first controller 150 may automatically perform steps 218 and 220 after the predetermined amount of time, and the second signal may be omitted.

When the valve 140 is in the second position, the compressed gas may flow from the compressor 130, through the valve 140, and into the annulus 166 in the well 160. The compressed gas may then flow down through the annulus 166 and into the tubing string 164 at a position below the plunger 170 and/or the second actuator 176. The compressed gas may then flow up through the tubing string 164, which may lift the plunger 170 back toward the surface. The method 200 may then loop back around to step 208. In another embodiment, an injection valve may be attached to the tubing string 164 at a location below the plunger 170 and/or the second actuator 176. The compressed gas may be injected through the injection valve and into the tubing string 164.

In yet another embodiment, the compressor 130 may pull (e.g., suck) on the tubing string 164. More particularly, gas at the upper end of the tubing string 164 may be introduced into the inlet 132 of the compressor 130. This may exert a force inside the tubing string 164 that pulls the plunger 170 upward. The outlet 134 of the compressor 130 may introduce the compressed gas into the annulus 166, as described above, or a portion of the compressed gas may be introduced into a sales line.

As will be appreciated, the system 100 and method 200 may control the injection of gas from the compressor 130 on demand by "unloading" the compressor 130 (e.g., as at 212 and/or 214) and "loading" the compressor 130 (e.g., as at 218 and/or 220) in response to the detection by the sensor 178, the predetermined amount of time, or a combination thereof. The system 100 and method 200 may also stop the compressor 130 before the compressor 130 runs out of sufficient gas to restart. By redirecting the gas to the pressure vessel 120 (i.e., unloading the compressor 130), the compressor 130 may avoid blowing down and/or emitting gas to the atmosphere. This is accomplished by unloading the compressor 130 back into the pressure vessel 120 and unloading the compressor 130 so that it may restart without any emission of gas to the atmosphere. In addition, by introducing the gas from the compressor 130 back into the pressure vessel 120, rather than releasing the gas into the atmosphere, the loud noise generated by the release of the compressed gas may be avoided. The environmental concerns caused by releasing the compressed gas into the atmosphere may also be alleviated.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for operating a gas-lift plunger in a well, comprising:

a controller in communication with a compressor a valve, and a sensor, wherein the controller is configured to perform operations, the operations comprising:

receiving a signal from the sensor representing that a gas-lift plunger has reached a position in a well that is proximate to a top of the well;

in response to receiving the signal:

causing the compressor to unload; and positioning the valve in a first position such that a gas flows from an outlet of the compressor to a pressure vessel, wherein the compressor is connected to the pressure vessel, and not into the well, and from the pressure vessel to an inlet of the compressor, wherein the valve is directly connected to the compressor;

determining that the plunger has descended in the well; and in response to determining that the plunger has descended in the well:

causing the compressor to load; and positioning the valve in a second position such that the gas flows from the outlet of the compressor to the well via the valve in the second position, wherein the gas flows from the pressure vessel into the inlet of the compressor, wherein the pressure vessel is located outside the well.

2. The apparatus of claim 1, wherein the pressure vessel comprises a separator.

3. The apparatus of claim 1, wherein causing the compressor to unload and positioning the valve in the first position such that the gas from the outlet of the compressor flows from the outlet to a separator, and back to the inlet of the compressor is configured to avoid venting the gas to an ambient environment while the gas-lift plunger descends in the well.

4. The apparatus of claim 1, wherein determining that the plunger has descended in the well comprises determining that the plunger has been allowed to descend for a predetermined amount of time.

5. The apparatus of claim 4, wherein causing the compressor to unload comprises sending a signal to a driver coupled to the compressor, wherein the signal sent to the driver is configured to cause the driver to reduce speed.

6. The apparatus of claim 1, wherein, when the valve is positioned in the second position, the gas that flows from the pressure vessel to the inlet of the compressor is received in the pressure vessel from the well.

7. The apparatus of claim 1, wherein causing the compressor to unload comprises causing the compressor to stop compressing the gas, and wherein causing the compressor to load comprises causing the compressor to compress the gas.

8. A system for operating a gas-lift plunger in a well, comprising:

a pressure vessel positioned outside of the well, wherein the pressure vessel is configured to contain a gas therein;

a compressor comprising a driver, an inlet, and an outlet, wherein the compressor is configured to compress the gas between the inlet and the outlet, wherein the gas is fed to the inlet from the pressure vessel, wherein the compressor is connected to the pressure vessel;

a valve coupled to the outlet of the compressor, wherein the valve has a first position in which the valve directs the gas from the outlet of the compressor to the pressure vessel, and wherein the valve has a second position in which the valve directs the gas from the outlet of the compressor to the well, wherein the valve is directly connected to the compressor; and a controller in communication with the driver of the compressor and with the valve, wherein the controller is configured to:

determine that the gas-lift plunger has reached a predetermined position in the well;

in response to determining that the gas-lift plunger has reached the predetermined position, cause the compressor to stop compressing the gas, and cause the valve to be in the first position such that the gas at the outlet of the compressor is directed into the pressure vessel and not to the well;

determine that the gas-lift plunger has descended in the well; and in response to determining that the gas-lift plunger has descended in the well, cause the compressor to compress the gas and cause the valve to be in the second position such that the gas at the outlet of the compressor is directed to the well.

9. The system of claim 8, wherein the pressure vessel comprises a separator, and wherein the separator is configured to receive the gas from the well.

10. The system of claim 8, wherein directing the gas from the outlet of the compressor to the pressure vessel via the valve in the second position avoids venting the gas from the compressor to an ambient environment.

11. The system of claim 8, further comprising a sensor configured to determine when the gas-lift plunger is at the predetermined position and signal to the controller in response thereto.

12. The system of claim 8, wherein the controller is configured to determine that the gas lift-plunger has descended in the well based on a predetermined amount of time expiring during which the plunger descends.

13. A method for operating a gas-lift plunger in a well, comprising:

receiving a signal from a sensor, the signal representing that the gas-lift plunger has reached a position in the well that is proximate to the top of the well;

in response to receiving the signal;

causing a compressor to stop compressing a gas between an inlet of the compressor and an outlet of the compressor; and positioning a valve in a first position, the valve in the first position being configured to receive the gas from the outlet of the compressor and feed the gas to a pressure vessel that is positioned outside of the well, wherein the gas is received at the inlet of the compressor from the pressure vessel;

determining that the plunger has descended in the well; and

In response to determining that the plunger has descended in the well;

causing the compressor to compress the gas between the inlet and the outlet of the compressor; and positioning the valve in a second position such that the gas flows from the outlet of the compressor to the well via the valve in the second position, wherein the compressor is connected to the pressure vessel, and wherein the valve is directly connected to the compressor.

14. The method of claim 13, wherein the pressure vessel comprises a separator, and wherein the inlet of the compressor receives the gas from the separator when the valve is in the first position and when the valve is in the second position.

15. The method of claim 13, wherein positioning the valve in the first position prevents the gas from flowing from the outlet of the compressor into the well.

16. The method of claim 13, further comprising receiving the gas from the well and into the inlet of the compressor when the valve is in the second position.

17. The method of claim 13, wherein causing the compressor to stop compressing the gas and positioning the valve in the first position such that gas from the outlet of the compressor is fed to the pressure vessel is configured to avoid venting the gas from the compressor to an ambient environment.

18. The method of claim 13, herein determining that the plunger has descended in the well comprises determining that a period of time has elapsed during which the plunger was allowed to descend.

19. The method claim 13, wherein causing the compressor to stop compressing the gas comprises sending a signal to driver coupled to the compressor, to sloe a speed of the driver, and wherein causing the compressor to compress the gas comprises sending another signal to the driver, to increase a speed of the driver.

20. The method of claim 19, wherein positioning the valve in the first position prevents the gas from flowing into the well.

* * * * *